US006293175B1

(12) United States Patent
Enwald et al.

(10) Patent No.: US 6,293,175 B1
(45) Date of Patent: Sep. 25, 2001

(54) WEB CUT-OFF DEVICE

(75) Inventors: Petri Enwald, Tuusula; Aaron Mannio, Järvenpää; Pekka Ruha, Helsinki; Kalevi Vesterinen, Vantaa, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/297,283

(22) PCT Filed: May 29, 1998

(86) PCT No.: PCT/FI98/00455

§ 371 Date: Jun. 7, 1999

§ 102(e) Date: Jun. 7, 1999

(87) PCT Pub. No.: WO98/55688

PCT Pub. Date: Dec. 10, 1998

(30) Foreign Application Priority Data

Jun. 2, 1997 (FI) ..... 972329

(51) Int. Cl.[7] ..... B26D 1/04

(52) U.S. Cl. ..... 83/13; 83/639.1; 91/25

(58) Field of Search ..... 83/639.1–639.7, 83/554, 13; 30/210, 216, 229, 277.4; 91/25, 26

(56) References Cited

U.S. PATENT DOCUMENTS

| | | | | |
|---|---|---|---|---|
| 1,825,632 | * | 9/1931 | Korvin-Kroukovsky . | |
| 2,518,871 | * | 8/1950 | Craig . | |
| 2,648,949 | * | 8/1953 | Taylor . | |
| 2,703,557 | * | 3/1955 | Polki . | |
| 2,953,117 | * | 9/1960 | Wandel . | |
| 4,026,192 | * | 5/1977 | Noren et al. . | |
| 4,030,391 | | 6/1977 | Swanson et al. | 83/137 |
| 4,173,171 | * | 11/1979 | Lange . | |
| 4,823,658 | | 4/1989 | Spicer | 83/74 |
| 5,765,462 | | 6/1998 | Mannio | 83/639.5 |

FOREIGN PATENT DOCUMENTS

| | | |
|---|---|---|
| 320043 | 4/1920 | (DE) . |
| 3333233 | 3/1985 | (DE) . |
| 0739695 | 10/1996 | (EP) . |
| 97339 | 8/1996 | (FI) . |
| 8700776 | 2/1987 | (WO) . |

* cited by examiner

*Primary Examiner*—Kenneth E. Peterson
(74) *Attorney, Agent, or Firm*—Steinberg & Raskin, P.C.

(57) ABSTRACT

A web cut-off device including a frame defining a piston chamber, a piston movable in the piston chamber, a cutter blade attached to the piston such that upon movement of the piston in a first direction, the cutter blade is adapted to engage and cut a web, at least one pressure chamber and lower connecting ducts for connecting the pressure chamber (s) to a lower part of the piston chamber. The ducts opening directly into opposed side walls defining the piston chamber such that the piston operates as a valve between the piston chamber and the pressure chamber(s). The device also includes at least one return pressure duct in communication with an upper part of the piston chamber such that upon introduction of pressure into the return pressure duct(s), the piston is moved in a second direction opposite to the first direction, and at least one bottom duct in communication with a bottom of the piston chamber such that by introducing pressure into the bottom of the piston chamber via the bottom duct(s), movement of the piston in the first direction is initiated and by evacuating pressure from the bottom of the piston chamber via the bottom duct(s), the piston is maintained stationary in the piston chamber. A method for cutting a web using the device is also disclosed.

15 Claims, 3 Drawing Sheets

WEB CUT-OFF DEVICE

FIELD OF THE INVENTION

The invention concerns a web cut-off device for cutting a web in a web-handing machine such as a paper machine and a coating machine.

BACKGROUND OF THE INVENTION

In devices for processing of a paper web, such as, for example, paper machines and coating machines, cut-off devices are used, whose function is to cut off the web at a number of points when some disturbance of operation takes place in the machine, such as, for example, an uncontrolled web break. The purpose of the cutting off is to protect components that might be damaged when the paper web proceeds as wrinkled and having lost its tension inside the machine, for example, through a coating station or through a calender with soft rolls.

Further, a cut-off device is employed in reelers as a part of the machine reel change equipment. At present, for cutting off a paper or board web, among other things, the following methods are used:

Board and paper grades whose basis weight is high, typically >150 g/m$^2$ (grams per square meter), are cut off by using a so-called bag change or a cutting band or a cutting string. In bag change, the machine reel that is being completed is slowed down while, at the same time, pressurized air is blown to below the web. The web rises and forms a bag and enters into the nip. A sudden jerk cuts off the web. In change by means of a band, a separate band or string is fed to which an adhesion face has been fitted, for example, by means of an adhesive tape at the inlet side of the nip so that the adhesive tape affixes the band to the face of the reel spool outside the web, and the web tears the web apart in the nip while winding the web in spiral shape around the reel spool. In band change devices, the band that cuts off the board or paper web remains in the interior of the machine reel that is being completed on the face of the reel spool, where it produces bottom broke. The board/paper is glazed at the band over a thickness of several tens of windings. Nor is the reliability of operation of band change devices good, and their operation requires an abundance of manual work and great care.

With medium-weight paper grades, from about 80 to about 150 g/m$^2$, a so-called swan-neck change is employed, in which a little cut is cut into the web before the nip, and after the nip pressurized air is blown to the cut area, in which connection the web is torn up to the edges.

With thin paper grades, about <100 g/m$^2$, in reelers of the Optireel™ type marketed by the current assignee's, blowing from below the web or from the side is employed in order to pierce and to cut off the web. In particular with thin paper grades and at high running speeds, cutting off of a paper web by blowing produces detrimental paper chips, because the process of cutting is not controlled. With thicker paper grades, when blowing exclusively by means of pressurized air is employed, problems arise because the pressurized air cannot pierce the web or does the piercing untidily.

Further, there are applications in which a high-pressure water jet/jets is/are employed as the cutting element, which jets move across the web at a high speed. A problem of water-jet cutting is the necessity of very quick linear movements in the cross direction of the web and long cutting tails. In water-jet cutting, uncontrolled web breaks may also arise, in which case the web is torn by itself further from the cut that has been made by the jet.

There are also applications in which various mechanically striking blades are employed, which cut off the web as of full width.

The current assignee's FI Patent No. 97,339 constitutes the prior art most closely related to the present invention. In said patent, a cut-off device based on a mechanical blade is described. Said cut-off device includes a cut-off blade and an actuator that is fitted to act upon the cut-off blade to produce a cut-off stroke. The actuator consists of a number of cylinders fitted inside a chamber, each of which cylinders includes a piston and a piston rod. The piston rods have been attached with a certain spacing to a cut-off blade extending across the whole web width. A rapid stroke of the cut-off device is produced by means of rapidly opening pressure-controlled control valves of large area for the cylinders attached to the cut-off blade and by placing the cylinders in the interior of a pressure chamber so that the path of the compressed air from the pressure chamber into the cylinders is as short as possible.

In the cut-off device described in the FI Patent 97,339, variation may occur in the cutting speed. This comes at least from wear of the seals of the retainers and/or from problems related to the two-part structure of the instant-discharge principle used for the discharge.

However, when it operates correctly, cutting off taking place by means of a blade involves a number of advantages, such as controlled cutting off and tidy cutting result also at high speeds, as well as easy regulation of the cutting capacity by means of regulation of pressure in compliance with the paper grade to be cut off.

OBJECTS AND SUMMARY OF THE INVENTION

The object of the present invention is to provide a very rapid and precise cutting off of a web based on a mechanical cut-off blade extending across the whole web width.

In order to achieve this object and others, a web cut-off device in accordance with the invention comprises means defining a piston chamber having a pair of opposed side walls, a piston movable in the piston chamber, a cutter blade attached to the piston such that upon movement of the piston in a first direction, the cutter blade is adapted to engage and cut a web, means defining at least one pressure chamber and lower connecting ducts for connecting the pressure chamber (s) to a lower part of the piston chamber. The ducts open directly into the side walls of the piston chamber and at least at level of a bottom face of the piston chamber such that the piston operates as a valve between the piston chamber and the pressure chamber(s). The device also includes at least one return pressure duct in communication with an upper part of the piston chamber such that upon introduction of pressure into the return pressure duct(s), the piston is moved in a second direction opposite to the first direction, and at least one bottom duct in communication with a bottom of the piston chamber such that by introducing pressure into the bottom of the piston chamber via the bottom duct(s), movement of the piston in the first direction is initiated and by evacuating pressure from the bottom of the piston chamber via the bottom duct(s), the piston is maintained stationary in the piston chamber. Stop cushions may also be arranged in a top portion of the piston chamber for stopping movement of the piston in the first direction.

A cut-off device in accordance with the present invention can be used for cutting off of all paper and board grades.

The device is easy to manufacture, because its construction is very simple and it comprises just one mobile part. The tightness of the device also remains stable, because the backup face of sealing consists of the lower face of the piston, which retains its shape very well.

With a cut-off device in accordance with the invention, within normal pressure ranges of compressed-air systems, max. about 7 bars, very high rates of accelerations of up to 1000×g and very high speeds of 30 meters per second can be achieved. High speed is an essential property required in cutting off of a paper and board web. A particularly high speed is also required when the web is cut off in the unwind stand of a coating machine or when running at a high speed.

The solution in accordance with the invention permits wider dimensioning of flow ducts and uniform supply of air to below the piston. This is why, behind the piston, full pressure is obtained immediately, which pressure results in an acceleration as efficient as possible. On the other hand, owing to the efficient acceleration, it is possible to achieve high speeds even with a piston of relatively low weight. As a result of this, it is possible to use a short acceleration distance, in which case the blade and the piston assembly become of lower height. This again results in a reduced mass and in lower forces of deceleration, which has the consequence of better mechanical strength in particular at high speeds.

Since the acceleration is efficient, full system pressures do not have to be used in the cut-off device either. This is why an adequate allowance for regulation of the stroke power is obtained so that the cut-off device can be used for cutting off of paper and board grades of highly different thicknesses.

Owing to its speed reserve and to the simultaneous timing in the cross direction of the web, the cut-off device in accordance with the invention is also highly insensitive to different variables in a papermaking process, which are usually detrimental to the carrying out of changes, and to the maximal values of said variables, to ranges of variations, cross-direction profiles, etc. Such variables include, among other things, the web speed, web tension, basis weight/grade, tension profiles, moisture, moisture profiles, web strengths, strength proportions.

The cut-off device can also be placed very freely in a machine, because the cut-off device is compact, and the cut-off device also operates when turned upside down because of the pneumatic retainer. Since the retaining takes place by means of a vacuum, the top side of the piston can be kept free from pressure, which improves the accelerations and speeds that are achieved.

As regards the discharge, the cut-off device operates highly reliably, for it operates even if a significant proportion of the discharge valves were not in operating condition. Since there are several discharge valves and since their operation is very quick, being directly electrically controlled, it is possible to achieve a highly simultaneous start of movement (typically <0.5 ms) across the entire length of the device. This is why the web can be cut off highly simultaneously across its entire width, in which case the cutting off is controlled and the risk of web break and/or of an uncontrolled tear is very little.

The invention will be described in the following with reference to the figures in the accompanying drawings, in which a preferred cut-off device in accordance with the invention is illustrated, the invention being, however not supposed to be confined to the details of said embodiment alone.

DETAILED DESCRIPTION OF THE PREFERRED EMBODIMENTS

Figure 1:
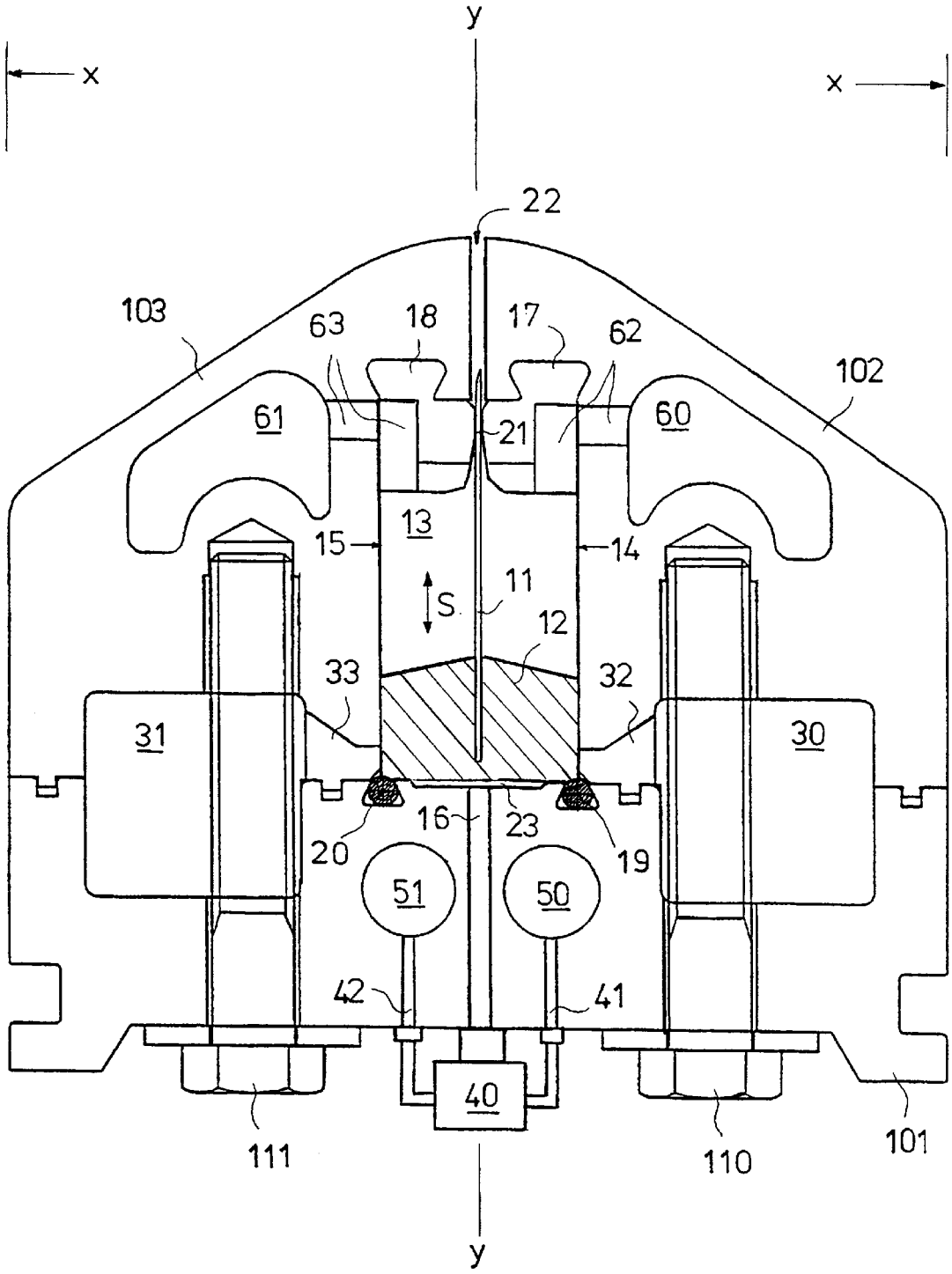
FIG. 1 is a schematic vertical sectional view of a preferred web cut-off device in accordance with the invention.

The frame part 100 of the web cut-off device as shown in FIG. 1 comprises a bottom piece 101 and a first 102 and a second 103 upper part to be attached to the bottom piece. Said first 102 and second 103 upper part are, in the direction of width X—X of the frame part 100, preferably mirror images of one another in relation to a vertical plane Y—Y fitted in the middle. In its longitudinal direction, the frame part 100 extends preferably across the entire width of the web to be cut off. The bottom piece 101 of the frame part 100 and the first upper part 102 are interconnected preferably by means of bolts 110, and the bottom part 101 and the second upper part 103 are, similarly, also interconnected by means of bolts 111. In the bottom piece 101 of the frame part 100, there are bores fitted for the bolts 110,111, and in the upper parts 102,103 of the frame part, similarly, there are threaded bores adapted to the threads on the bolts 110,111. The bolts 110,111 are placed with a suitable spacing across the length of the frame part 100 so that an adequate sealing can be achieved between the bottom piece 101 and the upper parts 102,103.

In the frame part 100 of the cut-off device, there is a cutter blade 11, which is attached directly to the piston 12, e.g., by means of spring cotters. On the other hand, the piston 12 is fitted in a piston chamber 13, in which it can move in the directions of the arrow S. The cutter blade 11, the piston 12 and the piston chamber 13 extend preferably substantially across the entire width of the web to be cut off. The piston chamber 13 has been shaped so that the first half of the piston chamber 13 has been formed into the first upper part 102 and the second half has been formed into the second upper part 103. The horizontal section of the piston chamber 13 is substantially shaped as an oblong rectangle. The first long side wall of the piston chamber 13 is denoted with the reference numeral 14 and the second long side wall with the reference numeral 15.

Further, the frame part 100 includes a first pressure chamber 30 in direct vicinity of the first long side wall 14 of the piston chamber 13 and a second pressure chamber 31 in direct vicinity of the second long side wall 15. From the first pressure chamber 30 a first short lower connecting duct 32 passes into the lower part of the first long side wall 14 of the piston chamber 13 to the level of the bottom of the piston chamber 13, and from the second pressure chamber 31, similarly, a second short lower connecting duct 33 passes to the lower part of the second long side wall 15 of the piston chamber 13 to the level of the bottom of the piston chamber 13. The pressure chambers 30,31 extend substantially across the entire length of the frame part 100. Moreover, the pressure chambers 30, 31 communicate with an outside source of pressure, which is not shown in the figure. The lower connecting ducts 32, 33 that pass from the pressure chambers 30,31 into the piston chamber 13 preferably consist of a number of separate ducts parallel to one another and fitted in the longitudinal direction of the frame part 100, i.e. in the cross direction of the web. It is also possible to imagine that, in stead of two pressure chambers 30,31, just one pressure chamber is employed, from which a number of separate lower connecting ducts pass into the piston chamber 13.

In the bottom piece 101 of the frame part 100 of the cut-off device, in said vertical plane Y—Y, there are bottom connecting ducts 16 that pass into the bottom of the piston chamber 13 to below the piston 12, which ducts can be connected through discharge valves 40 to a discharge pressure duct 50 and/or to a vacuum duct 51. The discharge pressure duct 50 communicates with an outside source of pressure, which is not shown in the figure, and the vacuum duct 51 communicates with an outside source of vacuum, which is not shown in the figure either. Discharge valves 40 and connected bottom connecting ducts 16 as well as connecting ducts 41,42 passing from the discharge valves 40 to the discharge pressure duct 50 and to the vacuum duct 51 are fitted with a suitable spacing, for example 5 to 10 per meter, across the entire length of the frame part 100.

Further, in the frame part 100, there is a first return pressure duct 60 in direct vicinity of the first long side wall 14 of the piston chamber 13, and a second return pressure duct 61 in direct vicinity of the second long side wall 15. From the first return pressure duct 60 a first short upper connecting duct 62 passes to the top portion of the first long side wall 14 of the piston chamber 13, and from the second return pressure duct 61 a second short upper connecting duct 63 passes to the top portion of the second long side wall 15 of the piston chamber 13. The return pressure ducts 60,61 extend substantially across the entire length of the frame part 100. Further, the return pressure ducts 60,61 communicate with an outside source of pressure, which is not shown in the figure. The upper connecting ducts 62,63 passing from the return pressure ducts 60,61 into the piston chamber 13 preferably consist of a number of separate ducts parallel to one another and fitted in the longitudinal direction of the frame part 100, i.e. in the cross direction of the web. It is also possible to imagine that, in stead of two return pressure ducts 60,61, just one return pressure duct is employed, from which a number of separate upper connecting ducts pass into the piston chamber 13.

Further, in the top portion of the piston chamber 13, there are piston 12 stop cushions 17,18. Between the stop cushions 17,18, a first slot 21 has been formed which guides the blade 11. Between the upper parts 102,103 of the frame part 100, at the vertical plane Y—Y, above the piston chamber 13, a second slot 22 has been formed. This second slot 22 is slightly wider than the first slot 21, and the blade 11 can move freely in this second slot 22 in the direction of the arrow S.

At the bottom of the piston chamber 13, at the long side walls 14,15 of the piston chamber 13, into the bottom piece 101 of the frame part, grooves have been machined for a seal band 19,20. When the piston 12 is in its lower position pressed against said seal bands 19,20, the pressure present in the pressure chambers 30,31 at the sides of the piston chamber 13 cannot act upon the bottom face of the piston 12. Below the piston 12, into the bottom of the piston chamber 13, into the space defined by the seal bands 19,20 in the lateral direction X—X, further, a shallow recess 23 has been formed, into which the connecting bottom ducts 16 are opened. This recess 23 may also be provided on the piston 12, in which case the bottom of the piston chamber 13 is smooth.

The upper parts 102,103 of the frame part 100 can also be made asymmetric if it is desirable, for example, to provide the apparatus with a blowing that facilitates the adhering of the cut-off web end to the face of a reel spool above the return pressure ducts 60,61.

The bottom piece 101, the upper parts 102,103 and the piston 12 of the device can be manufactured, for example, out of extruded profiles of light metal. The piston 12 and the blade 11 attached to the piston constitute the only mobile part in the frame part 100.

The size of the pressure chambers 30,31 and the cross-sectional flow areas of the lower connecting ducts 32,33 have been measured by means of computing so that the accelerating working pressure behind the piston 12 remains high over the whole duration of the stroke and that no throttle occurs in the lower connecting ducts 32,33, i.e. the losses of flow have been minimized. The return pressure ducts 60,61 have been measured so that the back pressure formed above the piston 12 during a stroke does not become very high. The return pressure ducts 60,61 also include instant discharge valves (not shown in the figures), by whose means the return pressure ducts 60,61 can be emptied quickly during a stroke, or, by means of the instant discharge valves, at least part of the air is allowed to pass out of the return pressure ducts 60,61 into the open air during the stroke.

In the following, the operation of the cut-off device will be described with reference to FIG. 1.

First, a return pressure is passed into the return pressure ducts 60,61 placed in the upper parts 102,103 of the frame part 100 at both sides of the piston chamber 13. This return pressure has access from the return pressure ducts 60,61 through the upper connecting ducts 62,63 passing into the piston chamber 13 to act upon the top part of the piston 12. In this connection, the piston 12 moves into the lower part of the piston chamber 13 and is pressed against the seal bands 19,20 placed there. At the same time, the piston 12 closes the lower connecting ducts 32,33 passing from the piston chamber 13 into the pressure chambers 30,31. When the piston 12 is pressed against the seal bands 19,20 provided at the bottom of the piston chamber 13, the pressure passed into the pressure chambers 30, 31 cannot pass to the bottom side of the piston 12, but it acts upon the side faces of the piston 12 only.

Secondly, the vacuum present in the vacuum duct 51 is connected, by means of charge valves 40, which are placed as densely spaced in the bottom piece 101, which are directly electrically controlled and which operate very quickly, to the recess 23 provided on the bottom of the piston chamber 13. From the vacuum duct 51, a connecting duct 41 of its own passes to each discharge valve 40, and, on the other hand, from each discharge valve 40 a connecting bottom duct 16 of its own passes to the recess 23 provided on the bottom of the piston chamber 13. The vacuum that is passed into the space defined by the bottom face of the piston 12 and by the recess 23 provided on the bottom of the piston chamber 13 keeps the piston 12 in its place pressed against the seal bands 19,20.

Thirdly, full working pressure is passed into the pressure chambers 30,31. Since the pressure present in the pressure chambers 30, 31 and attempting to raise the piston 12 can act substantially upon the side faces of the piston 12 only, the vacuum acting upon the bottom face of the piston 12 in the area defined by the distance between the seal bands 19,20 even alone is sufficient to keep the piston 12 down in a stand-by position ready for discharge.

As the fourth step, the return pressure which acts upon the top face of the piston 12 through the return pressure chambers 60,61 and through their upper connecting ducts 62,63 passing into the piston chamber 13 is removed. Depending on the work pressures and vacuums that are used, a security level can be defined for the construction in order to keep it in the stand-by position now formed. The security can be increased, if necessary, by allowing a slight return pressure to remain effective until the moment of discharge.

As the fifth step, by means of the discharge valves 40, the connection of the vacuum duct 51 to the connecting bottom ducts 16 is cut off, and at the same time a connection is opened from the discharge pressure duct 50 to the connecting bottom ducts 16 and through said ducts to below the piston 12. When the air pressure is increased in a very short time below the piston 12 to a certain limit value, the piston 12 starts moving upwards, in which connection the lower connecting ducts 32,33 passing from the bottom portion of the piston chamber 13 into the pressure chambers 30,31 are opened, and the pressure present in the pressure chambers 31,32 can flow to underneath the piston 12. The piston 12 is accelerated very quickly to the desired stroke speed, which can be regulated by regulating the working pressure employed in the pressure chambers 31,32. When the piston 12 moves upwards, the blade 11 attached to the piston also moves upwards and strikes against the web and cuts it off at the desired point.

As the sixth step, the pressure is removed from the pressure chambers 30,31 and the return pressure is connected to the return pressure ducts 60,61, in which connection the piston 12 and the connected blade 11 move into the initial position to the bottom of the piston chamber 13. The piston 12 positions itself against the seal bands 19, 20 provided at the bottom of the piston chamber 13.

In the following, the use of the cut-off device in a reel change situation at a reel-up will be described with reference to FIGS. 2 to 5.

Figure 2:
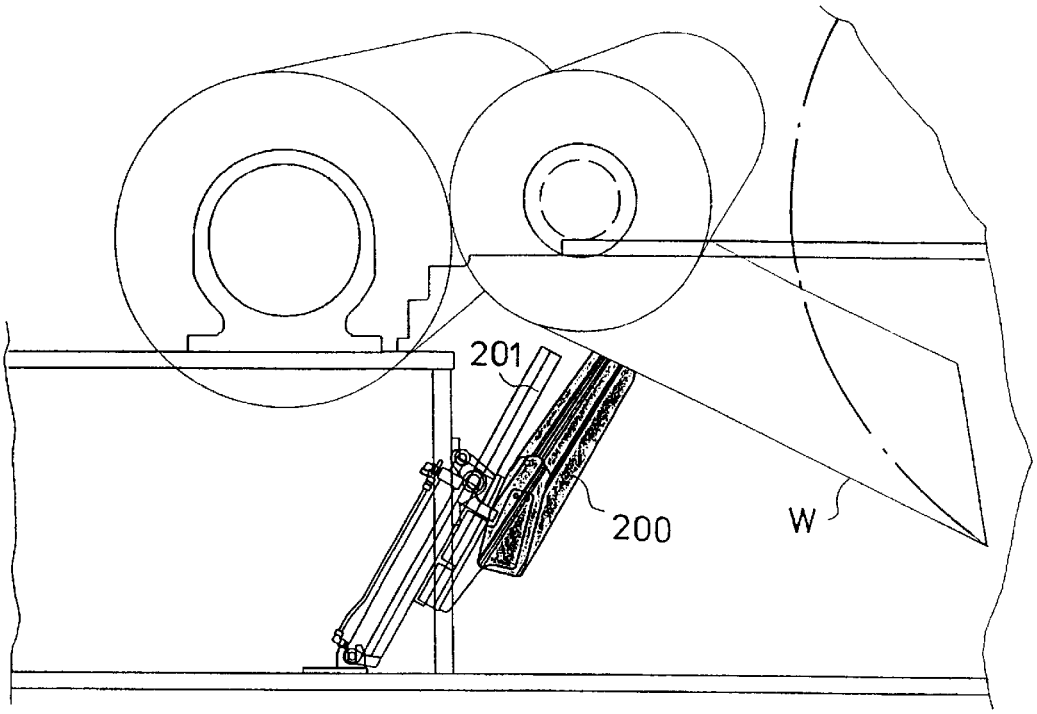
In FIG. 2 the web cut-off device is illustrated in its home position.

In FIG. 2, the cut-off device is in its home position, in which it can operate, for example, as a pulper guard. The frame part of the cut-off device has been fitted on a suitable shield box 200, and the shield box 200 is again attached, for example, to hydraulic arms 201, by whose means the frame part can be shifted towards the web W and apart from the web. At the same time, the shield box operates as a rigidifier of the frame part.

Figure 3:
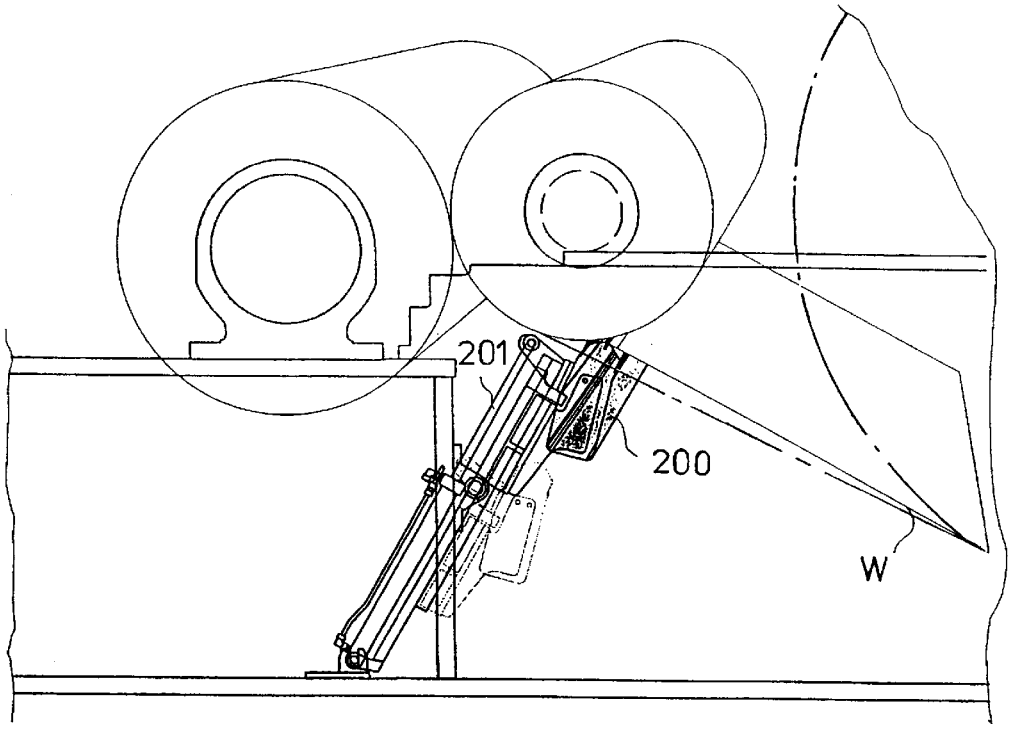
In FIG. 3 the web cut-off device has been shifted from its home position into contact with the web.

In FIG. 3, the cut-off device has been shifted from its home position against the web W. The upper part or upper parts of the frame part is/are in contact with the web W and raise(s) the web W slightly. When a thin paper grade is being cut off, the cut-off device can be placed apart from the web, because the high stroke speed is sufficient to cut off the web even if the web were not supported against the device.

Figure 4:
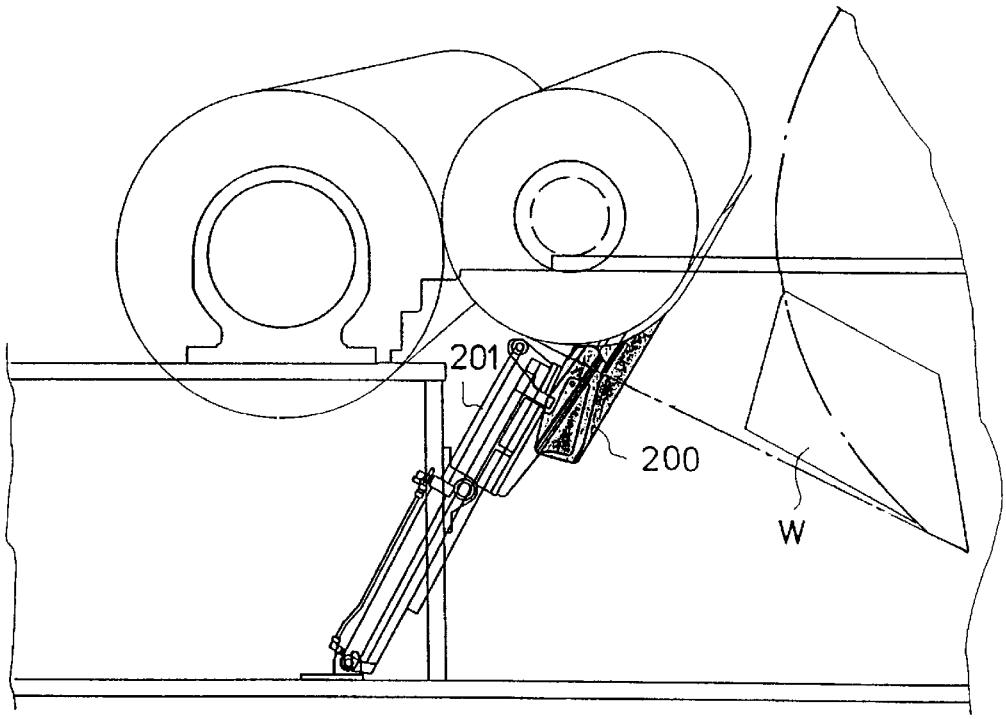
In FIG. 4 the web cut-off device has been discharged and the web has been cut off.

In FIG. 4, the web W has been cut off by discharging the cut-off device. After this, the cut-off device can again be returned to its home position.

Figure 5:
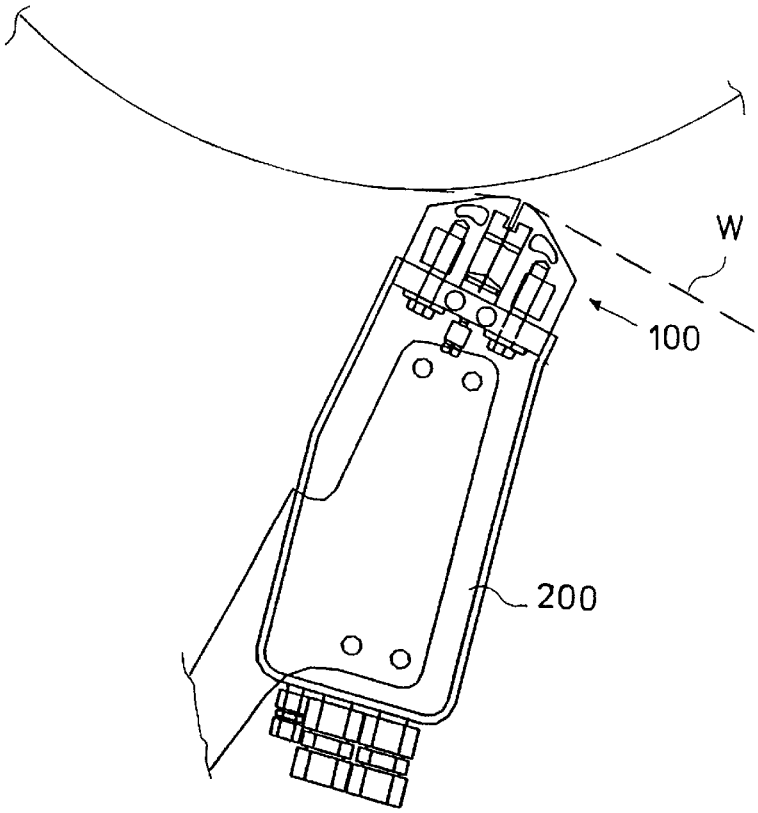
FIG. 5 is an enlarged view of the cut-off device in the situation shown in FIG. 3.

FIG. 5 is an enlarged view of the cut-off device in the situation shown in FIG. 3. In this situation, the frame part 100 of the cut-off device is ready to be discharged against the web W, and it raises the web W slightly in order that the web W should be tight when the cut-off blade is discharged against the web W.

In the following, the patent claims will be given, and the details of the invention can show variation within the scope of the inventive idea defined in said claims and differ from what has been stated above by way of example only.

What is claimed is:

1. A method for cutting a web, comprising the steps of:

applying a return pressure at a top of a piston chamber to move a piston to a bottom of te piston chamber, maintaining the piston at the bottom of the piston chamber by applying a vacuum force below the piston, the piston having with a cutter blade attached to the top of the piston and adapted to engage and cut the web, introducing a pressure into at least one pressure chamber in flow communication with a lower side part of the piston chamber such that the pressure bears against a side of the piston when the piston is at the bottom of the piston chamber, removing the return pressure acting on a top of the piston, stopping the application of the vacuum force being applied below the piston, and introducing pressure below the piston to cause movement of the piston toward the top of the piston chamber such that upon movement of the piston, the at least one pressure chamber is in flow communication with the piston chamber and the pressure in the at least one pressure chamber is effective against a lower part of the piston to accelerate the piston and the cutter blade to thereby cut the web.

2. The method of claim 1, further comprising the steps of evacuating the pressure from the at least one pressure chamber, and applying the return pressure at the top of the piston chamber to move the piston to the bottom of the piston chamber.

3. A web cut-off device, comprising:

means defining a piston chamber, said means including a pair of opposed side walls, a piston movable in said piston chamber, a cutter blade attached to said piston such that upon movement of said piston in a first direction, said cutter blade is adapted to engage and cut a web, means defining at least one pressure chamber, lower connecting ducts for connecting said at least one pressure chamber to a lower part of said piston chamber, said ducts opening directly into said side walls defining in part said piston chamber and at least at a level of a bottom face of said piston chamber such that said piston operates as a valve between said piston chamber and said at least one pressure chamber, at least one return pressure duct in communication with an upper part of said piston chamber but not in communication with said at least one pressure chamber such that upon introduction of pressure into said at least one return pressure duct, said piston is move in a second direction opposite to the first direction, at least one bottom duct in communication with a bottom of said piston chamber but not in direct communication with said at least one pressure chamber, means for introducing pressure into the bottom of said piston chamber via said at least one bottom duct in order to move the piston in said first direction, and means for evacuating pressure from the bottom of said piston chamber via said at least one bottom duct in order to maintain the piston stationary at the bottom of said piston chamber.

4. The device of claim 3, wherein said lower connecting ducts are separated from one another along each of said side walls.

5. The device of claim 3, wherein said at least one return pressure duct comprises first and second return pressure ducts, further comprising upper connecting ducts for connecting said first and second return pressure ducts to the upper part of said piston chamber.

6. The device of claim 3, wherein said at least one bottom duct comprises a plurality of bottom ducts.

7. The device of claim 3, further comprising stop cushions arranged in a top portion of said piston chamber for stopping movement of said piston in the first direction.

8. The device of claim 3, wherein said means for introducing pressure comprises at least one discharge valve in communication with said at least one bottom duct, and a discharge pressure duct in communication with said at least one discharge valve for enabling the introduction of pressure into the bottom of said piston chamber via said at least one bottom duct.

9. The device of claim 8, wherein said means for evacuating pressure comprises a vacuum duct in communication with said at least one discharge valve for enabling the evacuation of pressure from the bottom of said piston chamber via said at least one bottom duct.

10. The device of claim 3, further comprising at least one discharge valve in communication with said at least one bottom duct, and a vacuum duct in communication with said at least one discharge valve for enabling the evacuation of pressure from the bottom of said piston chamber via said at least one bottom duct.

11. The device of claim 3, further comprising seal bands arranged at a bottom of said piston chamber adjacent said side walls, said piston being arranged to abut against said seal bands when in a stationary position and thereby prevent communication between said at least one pressure chamber and the bottom of said piston chamber when said piston is in its stationary position.

12. The device of claim 11, wherein said means defining said piston chamber comprise a recess between said seal bands and in communication with said at least one bottom duct, said piston being urged against said seal bands upon introduction of a vacuum in said recess.

13. The device of claim 3, wherein said means defining said piston chamber comprise an elongate frame part defining a slot through which said cutter blade projects upon movement of said piston in the first direction.

14. The device of claim 3, wherein said means defining said piston chamber comprise a first frame part including a lower wall of said piston chamber, a second frame part attached to said first frame part and including one of said opposed side walls of said piston chamber and a third frame part attached to said first frame part and including the other of said opposed side walls of said piston chamber such that said piston chamber is defined by said first, second and third frame parts.

15. The device of claim 3, wherein said means defining at least one pressure chamber define first and second pressure chambers, at least one of said lower connecting ducts connecting said first pressure chamber to a lower part of one of said walls defining said piston chamber and at least one of said lower connecting ducts connecting said second pressure chamber to a lower part of the other one of said walls defining said piston chamber.

* * * * *